US007509912B2

(12) United States Patent
Stengel et al.

(10) Patent No.: US 7,509,912 B2
(45) Date of Patent: Mar. 31, 2009

(54) METHOD AND SYSTEM FOR HOLDING AND DISPLAYING AN ELECTRONIC FLAT PANEL DISPLAY FOR RETROFIT OR NEW INSTALLATION INTO A WORK SURFACE

(75) Inventors: Peter J. Stengel, Columbia, MD (US); Thomas White, Sykesville, MD (US)

(73) Assignee: Technical Furniture Group, LLC, Columbia, MD (US)

( * ) Notice: Subject to any disclaimer, the term of this patent is extended or adjusted under 35 U.S.C. 154(b) by 74 days.

(21) Appl. No.: 11/353,833

(22) Filed: Feb. 14, 2006

(65) Prior Publication Data

US 2006/0191445 A1 Aug. 31, 2006

Related U.S. Application Data

(63) Continuation of application No. 10/971,571, filed on Nov. 22, 2004, now abandoned, which is a continuation-in-part of application No. 10/616,461, filed on Jul. 9, 2003, now Pat. No. 7,047,890.

(60) Provisional application No. 60/436,515, filed on Dec. 27, 2002.

(51) Int. Cl.
*A47B 37/00* (2006.01)

(52) U.S. Cl. ..... 108/50.01; 108/143

(58) Field of Classification Search ..... 108/50.01, 108/50.02, 147, 1, 7, 25, 26; 312/223.2, 312/223.3, 223.6, 723.1; 248/917, 919, 920, 248/922, 923

See application file for complete search history.

(56) References Cited

U.S. PATENT DOCUMENTS 4,590,866 A 5/1986 Schairbaum
4,735,467 A 4/1988 Wolters
4,766,422 A 8/1988 Wolters
5,125,727 A 6/1992 Lechman
D329,551 S 9/1992 Lechman
D335,047 S 4/1993 Lechman
5,199,773 A 4/1993 Price
D335,782 S 5/1993 Lechman
RE034,266 E 6/1993 Schairbaum
D342,396 S 12/1993 Lechman
5,294,193 A 3/1994 Wegman (Continued)

*Primary Examiner*—José V Chen
(74) *Attorney, Agent, or Firm*—Mary B. Tung; Conwell, LLC

(57) ABSTRACT

A flat panel workstation system that may be retrofitted into an existing desktop/work surface for supporting and pivoting a flat panel display such as a liquid crystal display (LCD) from a closed position to an open, viewable position in front of a user. The system includes a sliding keyboard and mouse platform mounted underneath the front edge of the desk top/work surface and which automatically pivot a support panel atop the work surface (and attached flat panel display) to an upright position or closed flush position upon extension/retraction of the keyboard and mouse platform. The method of retrofitting the system includes, among others, the following steps; (1) removing, or cutting out, a section of a desk top to create a rectangular hole, (2) installing the support panel assembly in the rectangular hole, (3) attaching the sliding keyboard and mouse platform and damper assemblies to the underside of the desk top and the support panel assembly, and (4) attaching the flat panel display to the support panel assembly.

15 Claims, 14 Drawing Sheets

U.S. PATENT DOCUMENTS

| | | | | |
|---|---|---|---|---|
| 5,410,972 | A | 5/1995 | Schairbaum | |
| D364,049 | S | 11/1995 | Lechman | |
| 5,526,756 | A | 6/1996 | Watson | |
| D372,601 | S | 8/1996 | Roberts | |
| 5,572,935 | A | 11/1996 | Schairbaum | |
| 5,611,608 | A | 3/1997 | Clausen | |
| 5,622,395 | A | 4/1997 | Shine | |
| 5,626,323 | A | 5/1997 | Lechman | |
| 5,651,594 | A | 7/1997 | Lechman | |
| 5,655,823 | A | 8/1997 | Schairbaum | |
| 5,685,236 | A | 11/1997 | Lechman | |
| 5,699,225 | A | 12/1997 | Yavitz | |
| 5,699,744 | A | 12/1997 | Lechman | |
| 5,740,743 | A | 4/1998 | Schairbaum | |
| 5,957,059 | A | 9/1999 | Burhman | |
| 5,964,164 | A | 10/1999 | Lechman | |
| 6,019,051 | A | 2/2000 | Schairbaum | |
| 6,085,431 | A | 7/2000 | Schairbaum | |
| 6,092,883 | A | 7/2000 | Lechman | |
| D429,088 | S | 8/2000 | Lechman | |
| D429,579 | S | 8/2000 | Lechman | |
| 6,128,186 | A | 10/2000 | Feierbach | |
| 6,135,298 | A | 10/2000 | Lechman | |
| 6,152,046 | A * | 11/2000 | Schairbaum et al. | 108/25 |
| 6,168,250 | B1 | 1/2001 | Rogov | |
| D437,506 | S | 2/2001 | Lechman | |
| D438,401 | S | 3/2001 | Lechman | |
| D440,069 | S | 4/2001 | Lechman | |
| 6,237,507 | B1 | 5/2001 | Yanagisawa | |
| 6,286,440 | B1 | 9/2001 | Jyrungi | |
| 6,419,330 | B1 | 7/2002 | Lechman | |
| 6,431,377 | B1 | 8/2002 | Lechman | |
| 6,463,862 | B1 * | 10/2002 | Kuhlman et al. | 108/50.01 |
| 6,474,760 | B2 | 11/2002 | Rauls | |
| 6,553,919 | B1 | 4/2003 | Nevin | |
| 6,601,931 | B1 | 8/2003 | Schairbaum | |
| 6,609,465 | B2 | 8/2003 | Kolavo | |
| 7,047,890 | B2 * | 5/2006 | Korber et al. | 108/50.01 |

* cited by examiner

METHOD AND SYSTEM FOR HOLDING AND DISPLAYING AN ELECTRONIC FLAT PANEL DISPLAY FOR RETROFIT OR NEW INSTALLATION INTO A WORK SURFACE

CROSS-REFERENCE TO RELATED APPLICATIONS

This application is a Continuation of U.S. application Ser. No. 10/971,571, filed Nov. 22, 2004 now abandoned, which is a Continuation-in-part of Ser. No. 10/616,461, filed Jul. 9, 2003, now U.S. Pat. No. 7,047,890 B2, issued May 23, 2006, which claims priority to U.S. Provisional Application No. 60/436,515, filed Dec. 27, 2002.

BACKGROUND OF THE INVENTION

1. Field of the Invention

The present invention relates to computer workstations and, more particularly, to a method and apparatus for retrofitting a computer workstation equipped with a pivoting working surface that exposes a flat panel display (liquid crystal LCD or plasma) to an existing desk or other like structure.

2. Description of the Background

The advent of flat panel liquid crystal (LCDs) and plasma displays has changed the manner in which computer monitors must be mounted/supported and positioned for optimum "viewability". A LCD transmits images in a manner that is quite different from that found in a traditional cathode ray tube (CRT) monitor. A user must position himself/herself directly in front of a LCD, viewing it "straight on", to properly see the displayed images. A LCD's highly directional images and lower light emission levels make it difficult to position the unit on top of a traditional desk such that a user can view it straight on in an ergonomic manner, or to view the display's output through the glass surface found in the typical computer desk, as exemplified by that disclosed in U.S. Pat. No. RE 34,266 to Schairbaum.

However, because LCDs offer many advantages over traditional CRT monitors, such as requiring less overall space and using less energy, there is a need for more functional, ergonomically correct, and convenient multi-use computer workstations designed to accommodate flat panel LCDs. While the above-referenced, related U.S. patent application Ser. No. 10/616,461 fills this need with respect to complete, desk-like workstation assemblies, to the best of the knowledge of the present inventors, no prior art apparatus or method provides the means for retrofitting an existing desk, or other like structure, with a functional, ergonomically correct, and convenient-to-use flat panel LCD mounting/support assembly in which the display may be pivoted from a closed, secured position to an open position in front of a user.

SUMMARY OF THE INVENTION

It is, therefore, an object of the present invention to provide a compact, functional, ergonomically correct flat panel workstation system that may be retrofitted to existing desk tops and like structures.

It is another object to provide a method for retrofitting the compact, functional, ergonomically correct flat panel workstation system to existing desk tops and like structures.

It is yet another object to provide a flat panel workstation system that rotates a LCD into a viewable position in front of a user.

It is another object to provide a flat panel workstation system in which the pivoting of the LCD from a stored to a viewable position is triggered automatically by the user extending a sliding (i.e. pull-out) keyboard and mouse platform.

It is another object to provide a flat panel workstation system in which the action of pivoting the LCD is controlled so as to protect the delicate circuitry of the unit and to prevent personal injury and/or damage to any associated structure.

It is yet another object to provide a flat panel workstation system that positions a LCD at the ideal, viewable angle when open and perfectly level to a work surface when stored/closed.

It is another object to provide a flat panel workstation system with a flat panel LCD in which the LCD is automatically turned on when it attains the viewing position.

According to a preferred embodiment of the present invention, the above-described and other objects are accomplished by providing a flat panel workstation system that may be installed (i.e. retrofitted) in an existing desktop/work surface. The system includes a pivoting, integral support panel, affixed to two rotatable shafts, to which a flat panel LCD may be mounted. In addition, a sliding keyboard and mouse platform (e.g. keyboard shelf) is mounted on telescoping roller brackets that may be affixed underneath the front end of the desk top/work surface. Pivoting lever assemblies include lever arms coupled to the rotatable shafts and links coupled to the roller brackets. A hydraulic damper is coupled at one end to one of the lever arms and slidably attached at the other end in a slotted bracket affixed to the underside of the desk top/work surface. The lever assemblies serve to automatically pivot the support panel to an upright position upon extension of the keyboard and mouse platform. The damper freely extends as the support panel is opened to its upright position, but is engaged as the support panel is closed to bring the support panel and attached LCD to a safe and gentle stop.

In the preferred embodiment, the system of the present invention also includes a mercury switch for turning the LCD on once it has attained an upright position (i.e. the support panel is in the fully open position), and for turning it off when the support panel is in the closed position. As a preferred option, the sliding keyboard and mouse platform includes a locking device which prevents unauthorized access to the input device and to the LCD to protect the hardware. While the locking device may be a simple keylock, the presently preferred embodiment includes a Dialock® system by which multiple flat panel workstation systems, retrofitted to multiple desk tops/work surfaces in a common work area, may be centrally unlocked using a single transponder stick inserted in a wall receptacle. The Dialock® intelligent key system is completely tamper-proof.

Multiple flat panel workstation systems may be retrofitted to a large tabletop/work surface such as a conference table. A LCD is mounted on the support panel of each workstation system and a sliding keyboard and mouse platform is mounted on telescoping roller brackets underneath the edge of the work surface directly in front of each support panel and LCD. The pivoting mechanism for each LCD is as described above, and each LCD may be pivoted to an upright position, independently of the others, by extending the corresponding keyboard and mouse platform.

The method of installing, or retrofitting, the flat panel workstation system of the present invention to an existing desk top includes the following steps; (1) establishing an installation centerline on the desk top, (2) aligning a template with the centerline and securing it to the top surface of the desk top, (3) using the template to outline the section of the desk top that will be removed to make room for the flat panel workstation system, (4) removing, or cutting out, the outlined section of the desk top to create a rectangular hole, (5) aligning the template with the rectangular hole and securing it to the underside of the desk top, (6) drilling a plurality of pilot holes in the underside of the desk top, (7) installing a support panel assembly in the rectangular hole, (8) attaching a sliding keyboard and mouse platform assembly to the underside of the desk top and the support panel assembly, (9) attaching a damper assembly to the underside of the desk top and the support panel assembly, (10) attaching a VESA bracket to the back of a LCD, (11) attaching the LCD to the support panel assembly, and (12) adjusting the tension of the system's closing operation.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
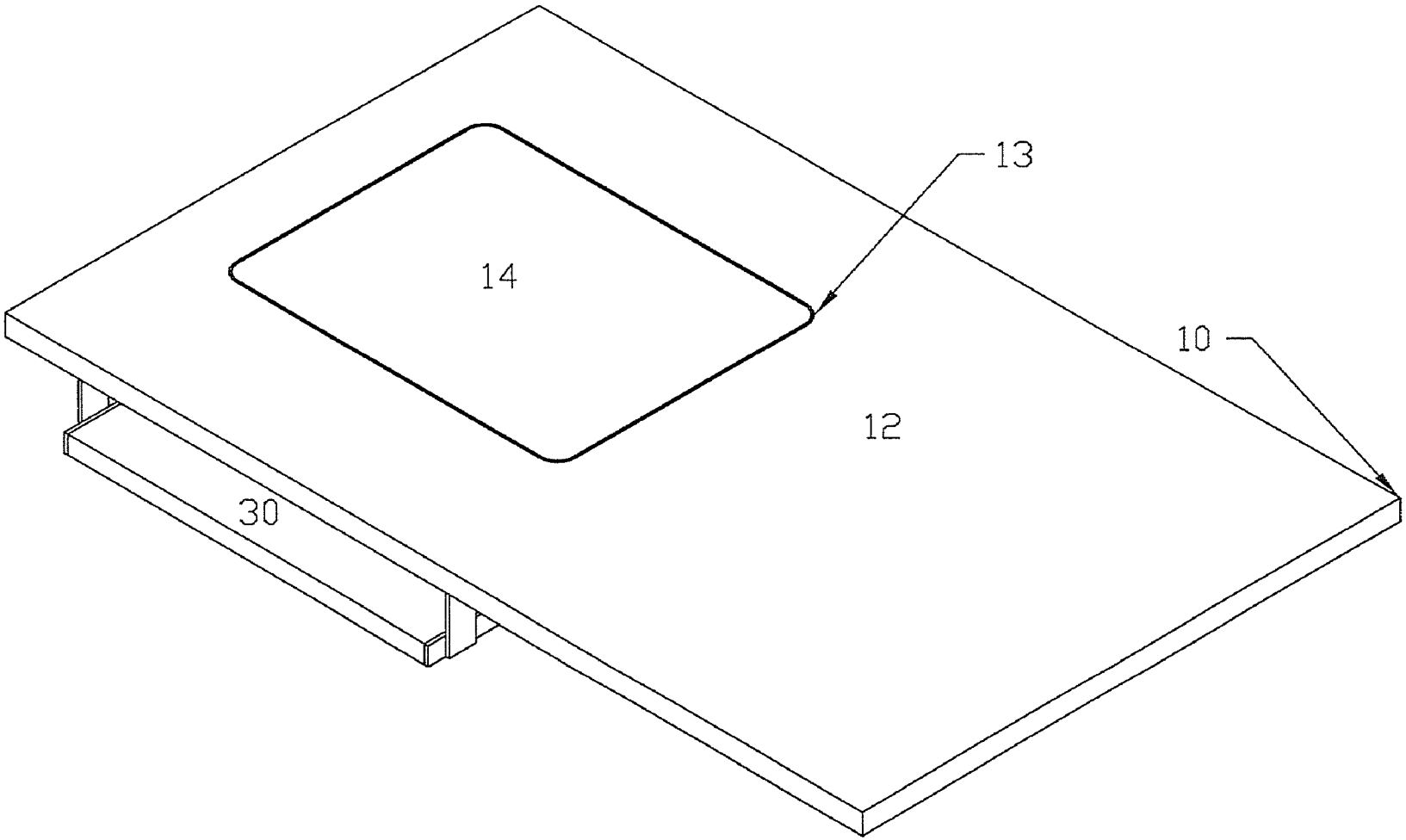
FIG. 1 is a front perspective view of a desk top 12 and a flat panel workstation system 10, shown with a LCD support panel 14 in the closed position and a sliding keyboard and mouse platform 30 in a fully retracted position, according to a preferred embodiment of the present invention.
Figure 2:
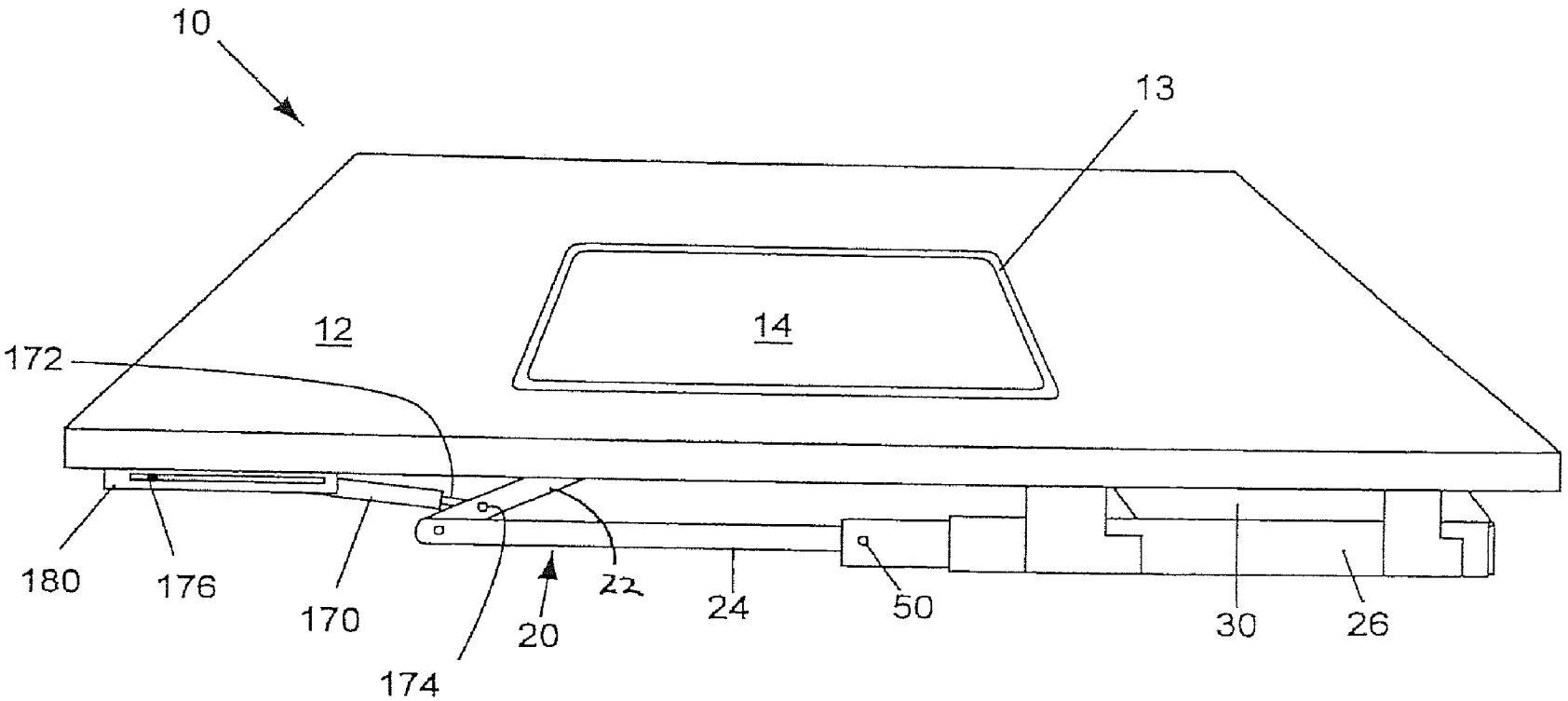
FIG. 2 is a side perspective view of the desk top 12 and flat panel workstation system 10 of FIG. 1, shown with the support panel 14 in a closed position.
Figure 3:
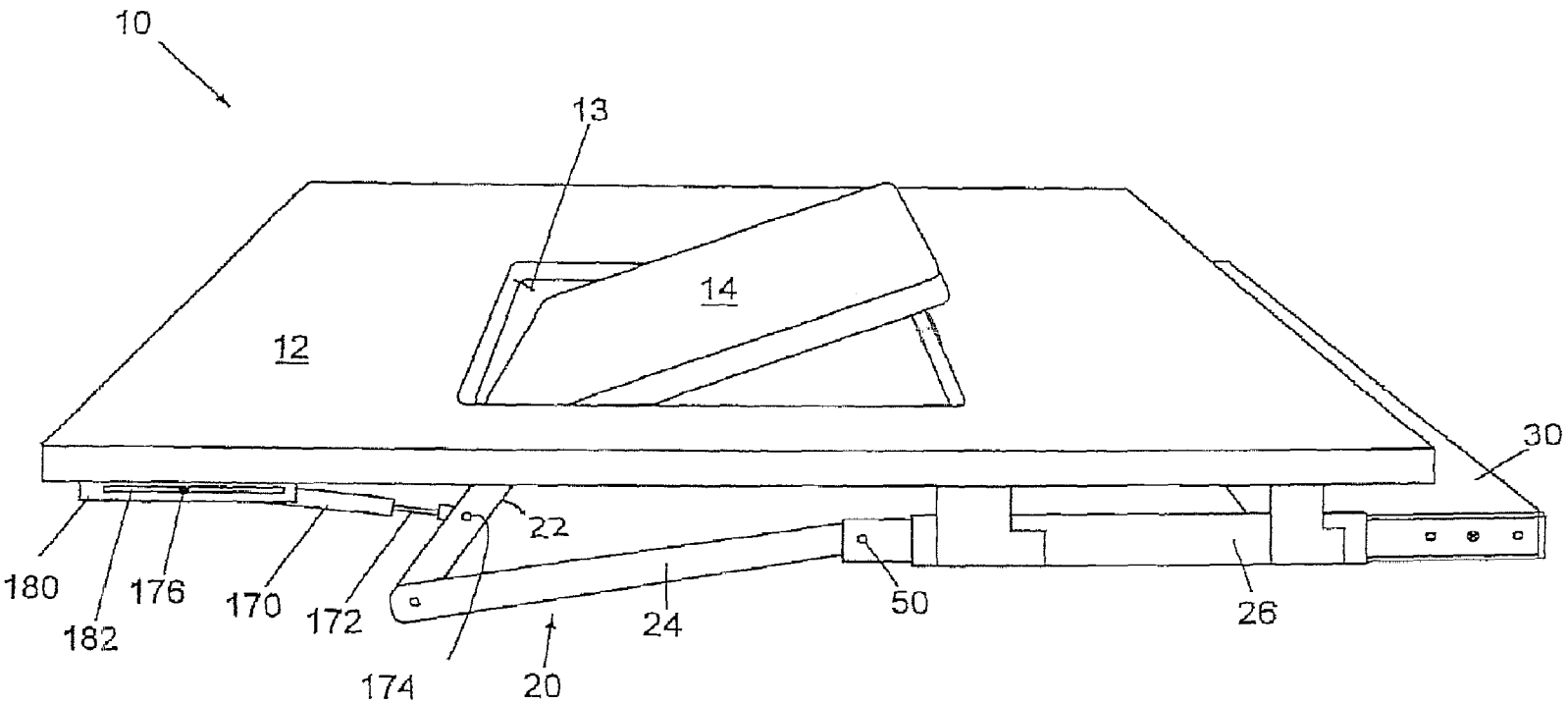
FIG. 3 is a side perspective view of the desk top 12 and flat panel workstation system 10 of FIGS. 1 and 2, shown with the support panel 14 in a partially open position.
Figure 4:
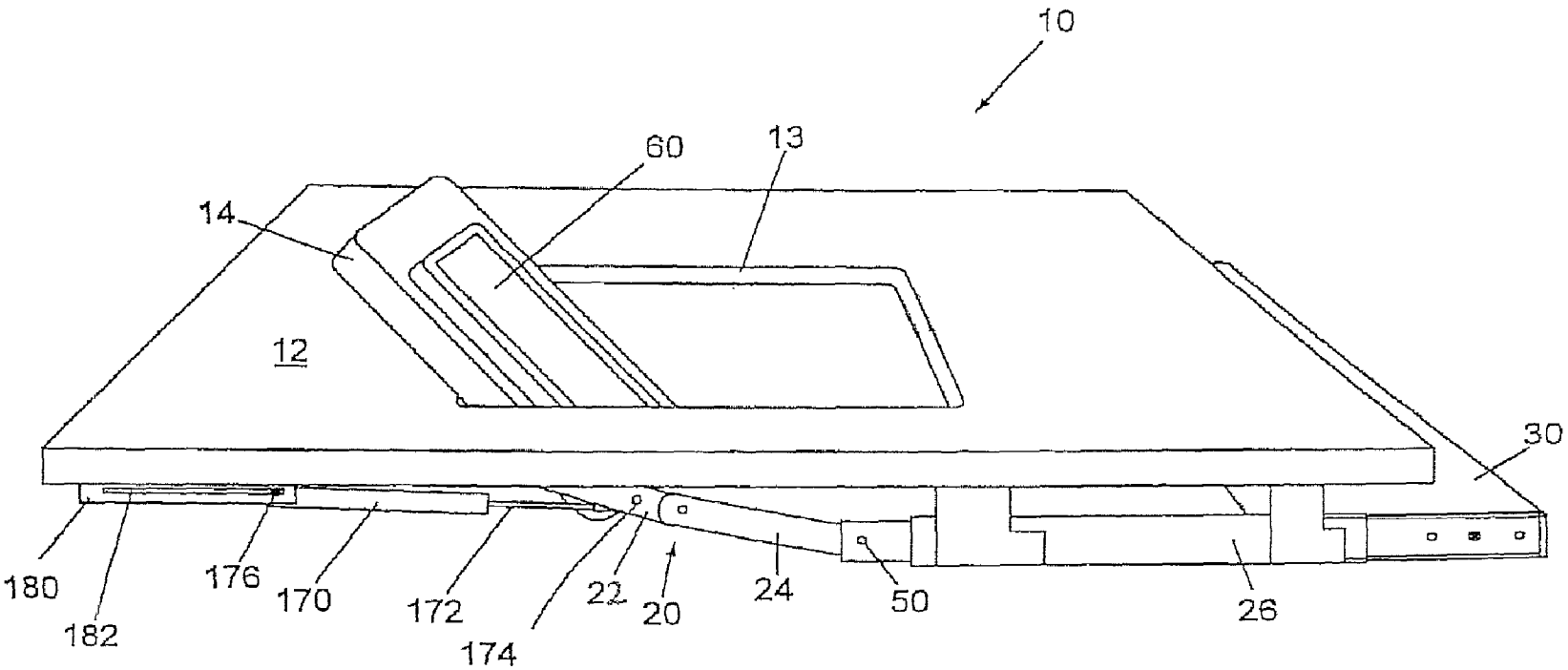
FIG. 4 is a side perspective view of the desk top 12 and flat panel workstation system 10 of FIGS. 1-3, shown with the support panel 14 and integrated LCD 60 in a fully open position.

FIG. 1 is a front perspective view of a flat panel workstation system 10, according to a preferred embodiment of the present invention, shown in conjunction with a desk top 12 (shown removed from the rest of the desk assembly). FIGS. 2-4 are side perspective views of the flat panel workstation system of FIG. 1, shown closed, partially open, and fully open, respectively. The workstation system 10 generally includes a sliding keyboard and mouse platform 30 and a pivoting support panel 14 in a desk top 12, the support panel 14 being adapted to support an integrated flat panel display 60 (LCD, plasma or otherwise) mounted thereon. Various mechanisms are provided for pivoting the support panel 14 and integrated flat panel display 60 into a fully open, working position. In the preferred embodiment shown in FIGS. 2-4, this mechanism comprise a linkage between the sliding keyboard and mouse platform 30 and a damping mechanism which, upon opening the platform 30, automatically and gently rotates the flat panel display 60 to a viewable position in front of a user. Additionally, the flat panel display 60 is preferably equipped with a gravity switch such as a mercury switch, such that said rotation of the support panel 14 and integrated flat panel display 60 automatically turn the flat panel display 60 on for viewing.

The flat panel workstation system 10 is adapted for retrofit installation into an existing desk top/work surface 12 in accordance with the installation method described herein. Toward this end, the flat panel workstation system 10 may be provided in kit form including an assemblage of components, inclusive of a collar 13 for installation in an aperture 100 cut into any substantially flat desk top/work surface 12, and a pivoting support panel 14 for installation into collar 13 for pivotably supporting the flat panel display 60 within the aperture 100. The collar 13 and support panel 14 sit flush with the desk top/work surface 12 when the panel 14 is closed.

Figure 5:
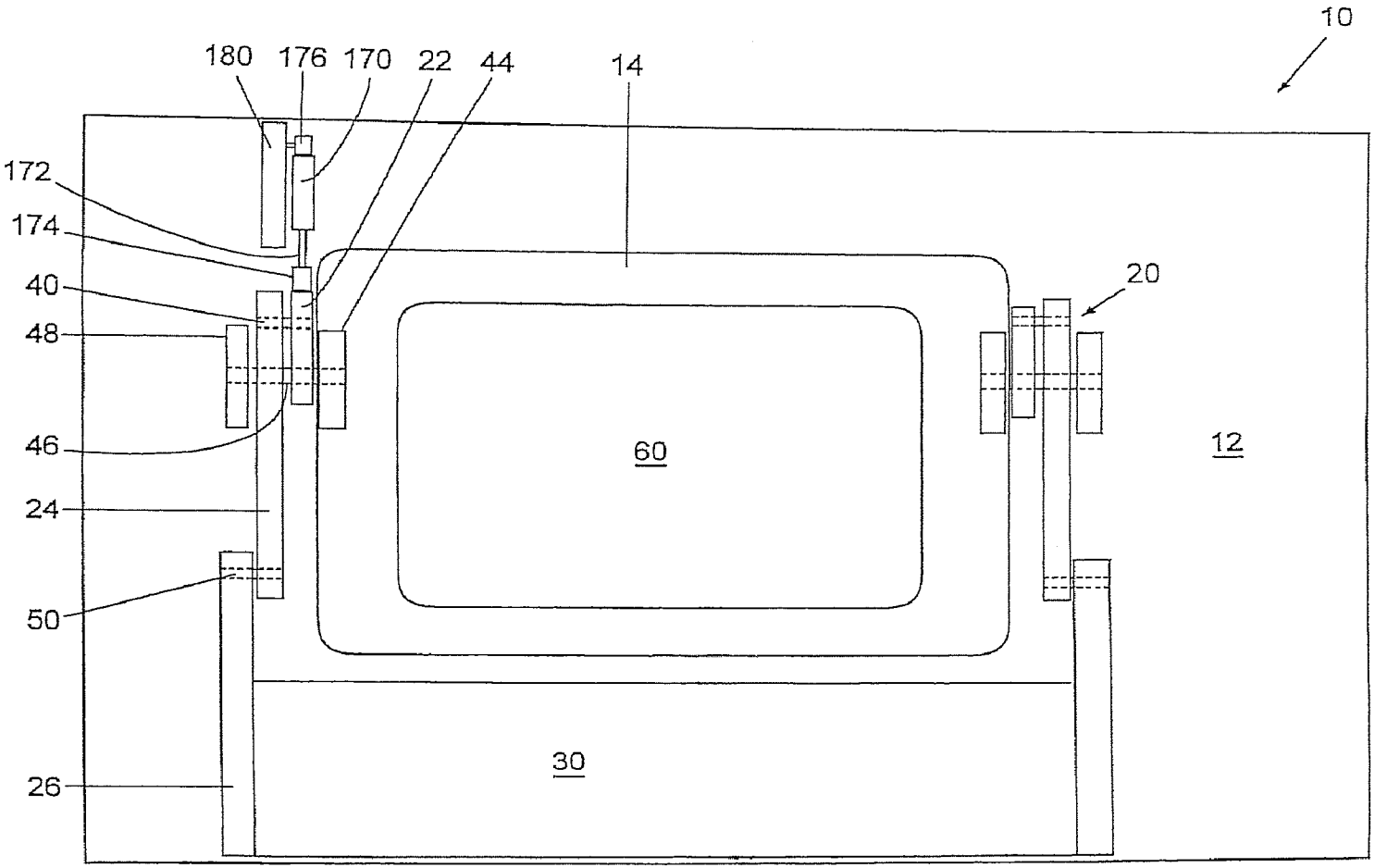
FIG. 5 is a bottom perspective view of the desk top 12 and flat panel workstation system 10 of FIGS. 1-4, shown with the support panel 14 and integrated LCD 60 in the closed position.

FIG. 5 is a bottom perspective view of the desk top 12 and flat panel workstation system 10 of FIGS. 1-4 that provides a detailed view of the system's various components. The support panel 14 is side-mounted to the collar 13 by two opposing coaxial, pivot shafts 46 which extend through lever arms 22 that are affixed at their bases 44 to the support panel 14. Offset lever assemblies 20 are attached to the other ends of lever arms 22 and thereby engage the support panel 14, allowing rotation of the panel 14 from a closed position to a fully open position, or vice versa. The lever assemblies 20 are linked to the keyboard and mouse platform 30 and are manually-actuated thereby. Specifically, keyboard and mouse platform 30 is slidably suspended beneath the front edge of the desk top/work surface 12 (on telescoping roller brackets 26 which are affixed to the underside of the desk top/work surface 12 in a spaced relationship). Each lever assembly 20 further comprises a lever arm 22 and a link 24. Each link 24 is pivotally attached at one end to a roller bracket 26 via, for example, a shoulder bolt 50. A hydraulic, double-ended or uni-directional damper 170, commercially available from AVM, Inc. of Marion, S.C. (i.e. as part/model no. sd200acjps006), is pivotally attached via a ball/socket assembly 174 to one of the lever arms 22 and slidably attached via an L-shaped bracket 176 to a slotted bracket 180 affixed to the underside of the desktop/work surface 12. With the support panel 14 in the closed position of FIG. 2, the damper's shaft 172 is fully retracted with the L-bracket 176 positioned at the back end of the slot 182 formed in the bracket 180.

The support panel 14 is pivoted to the partially open position of FIG. 3 by pulling the keyboard and mouse platform 30 out from under the front edge of the work surface 12. This action extends (i.e. telescopes outward) the two roller brackets 26 simultaneously (telescoping them outward). Movement of the roller brackets 26 then begins to draw the links 24 outward. The other ends of links 24 are pivotally attached to the free ends of the lever arms 22. Therefore, as links 24 move in response to the movement of the keyboard and mouse platform 30, lever arms 22 are pulled forward and slightly downward. Lever arms 22 in turn rotate the support panel 14 from the closed position of FIG. 2 to the partially open position of FIG. 3. As the lever. arms 22 respond to the extension of the keyboard and mouse platform 30, the damper 170 is set into motion causing the L-bracket 176 to traverse the slot 182 in the bracket 180.

FIG. 4 shows the flat panel workstation system 10 with the support panel 14 in a fully open position due to the complete extension of the keyboard and mouse platform 30. The lever assemblies 20 are fully engaged with the support panel 14 to rotate it to an approximately 80 degree vertical upright position (the angular position is a matter of design choice). The flat panel display 60, which is fixedly mounted to the underside of support panel 14, is automatically energized by mercury switch 62 and becomes fully viewable.

As the support panel 14 opens (i.e. rotates between the partially open position of FIG. 3 and the fully open position of FIG. 4), the L-bracket 176 traverses (left to right) the slot 182 in the bracket 180. However, the L-bracket 176 reaches the forward end of the slot 182 before the support panel 14 reaches its fully open position. When the motion of the L-bracket 176 is halted at the forward end of the slot 182, the shaft 172 of the damper 170 is freely extended as the support panel 14 opening process is completed gently. The extension of the shaft 172 in this manner readies the damper 170 for like operation during the closing of the support panel 14. The damped movement of the support panel 14 avoids damage to the flat panel display 60. The damped closing process occurs in the following manner.

As the support panel 14 is returned to the closed position of FIG. 2, the L-bracket 176 traverses (right to left) the slot 182 in the bracket 180 and reaches the back end of the slot 182 before the panel 14 reaches the closed position. When the motion of the L-bracket 176 is halted at the back end of the slot 182, the shaft 172 of the damper 170 is pushed into the damper's body, thereby engaging the internal damping system to bring the support panel 14 and attached flat panel display 60 to a safe and gentle stop in the closed position.

A minimal amount of shaft 172 extension is created as the opening process commences (see FIG. 3). The minimal amount of shaft 172 extension, generating a small amount of motion damping capability in the damper 170, is a safety feature designed to prevent the support panel 14 from slamming shut should the opening process be accidentally aborted prior to completion (e.g. a user inadvertently letting go of the keyboard and mouse platform 30 when the support panel is in the position shown in FIG. 3, whereupon gravity would act to return the panel to the closed position of FIG. 2).

The fit between the collar 13 and the support panel 14 serves to limit the rotation of the panel 14 and attached flat panel display 60, thereby ensuring that support panel 14 comes to rest flush with the work surface 12 when the desk 10 is closed (as in FIGS. 1 and 2).

The flat panel display 60 is preferably a commercially available 15"-20" flat panel LCD, plasma or other flat panel display. The flat panel display 60 is conventional in most respects, but is preferably equipped with an OEM-supplied and retrofitted gravity switch 62 (see FIG. 4), such as a mercury switch, for selectively applying power to the flat panel display 60 depending on its viewable orientation. The mercury switch 62 is mounted such that power is supplied to the flat panel display 60 when it is positioned at approximately an 60-70 degree upright angular orientation.

With reference to FIG. 5's bottom perspective view, showing the support panel 14 and flat panel display 60 in the closed position, the lever assemblies 20 on either side are identical, and only one need be explained in detail. As explained previously, the support panel 14 is side-mounted by a shaft 46. Each shaft 46 extends into the collar 13 at one end and through the base 44 of a lever arm 22 at the other end. The base 44 is rotatably engaged with the shaft 46 and is anchored to the support panel 14 by, for example, a plurality of screws. The shaft 46 is fixedly attached to the collar 13 which is mounted within the aperture 100 cut in the desk top/work surface 12 by, for example, a plurality of screws. The lever arm 22 extends rearwardly and slightly downwardly from its base 44. The free end of the lever arm 22 is pivotally attached at hinge 40 to one end of link 24 as shown. The other end of link 24 is, in turn, pivotally attached to a roller bracket 26 via a hinge 50 (i.e. shoulder bolt) such that inward or outward movement of the keyboard and mouse platform 30 telescopes the roller bracket 26 and operates the lever arm 22 and link 24, thereby pivoting the support panel 14. The commercially-available hydraulic damper 170 is, via its shaft 172, pivotally attached by a ball/socket assembly 174 to one of the lever arms 22 and slidably attached via an L-shaped bracket 176 to a slotted bracket 180 affixed to the underside of the desktop/work surface 12.

The foregoing flat panel workstation system 10 as installed serves to automatically pivot the support panel 14, positioned in the work surface 12, and the attached flat panel display 60 into a substantially vertical position in front of a user. The flat panel display 60 moves from a closed to an exposed/open position and is powered automatically when the user extends the sliding keyboard shelf 30. The mercury switch 62 in the flat panel display 60 closes upon attaining a substantially upright position, thereby ensuring that the flat panel display 60 is on only when desired.

The system 10 of the present invention need not necessarily include links 24 between the roller brackets 26 and the lever arms 22. In other words, the extension/retraction of the sliding keyboard and mouse platform 30 and the rotation of the support panel 14, between its open and closed positions, may occur independently of one another. When configured in this manner, the rotation of the support panel 14, between its open and closed positions, may be by manual operation, or by a motorized pivot mechanism using a conventional motor.

Figure 6:
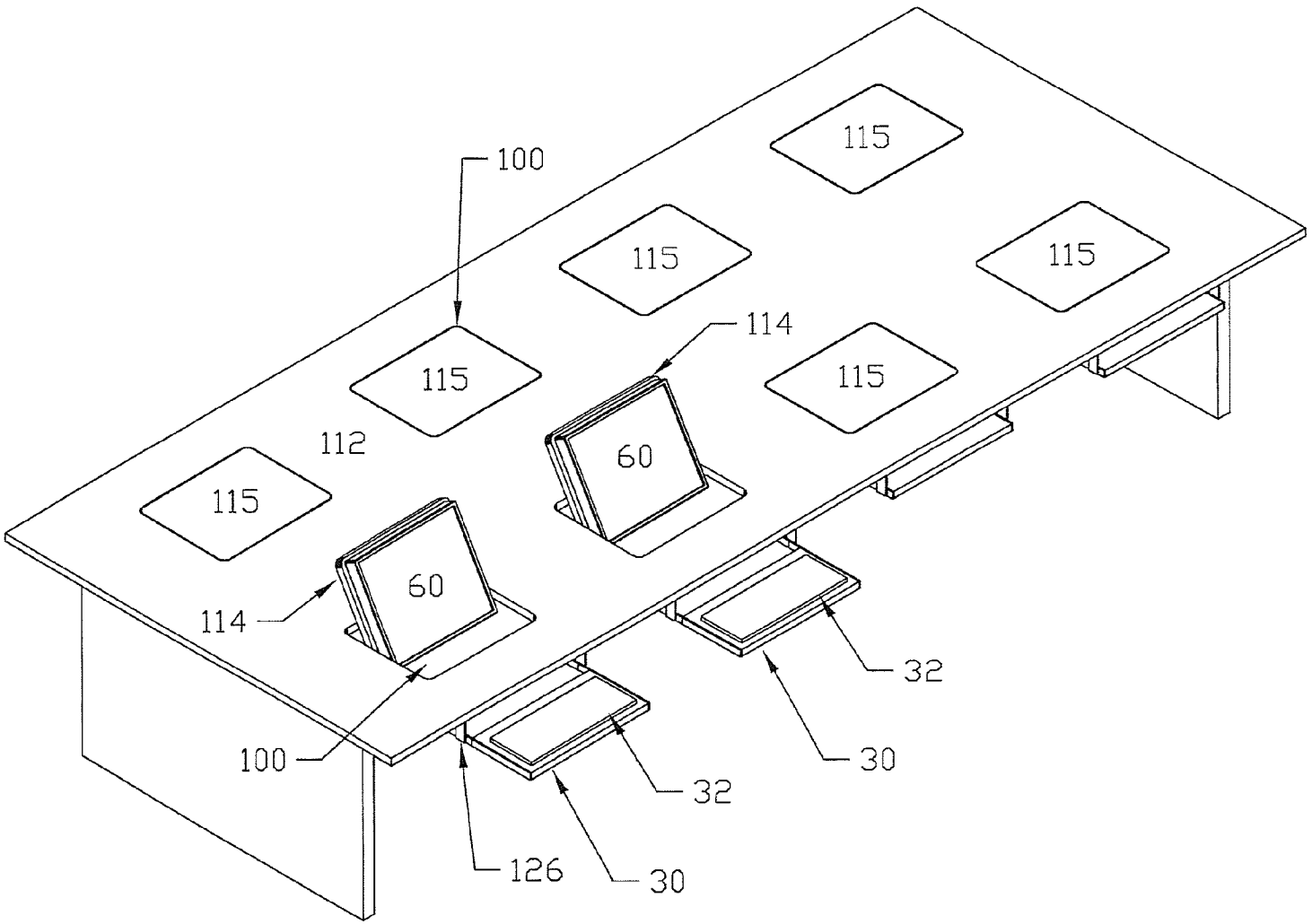
FIG. 6 is a top perspective view showing a plurality of flat panel workstation systems 10 retrofitted into a single, large tabletop/work surface 112.

FIG. 6 is a top perspective view showing the installation/retrofitting of a plurality of flat panel workstation systems 10 in a plurality of apertures 100 cut into a single, large tabletop/work surface 112, such as a conference table. Two support panels 114 are shown in an open position (i.e. an 80 degree vertical upright position), due to the complete extension of the corresponding keyboard and mouse platforms 30 (supporting computer keyboards 32), and six support panels 115 are shown in a closed position. Each support panel 115 sits flush with the tabletop/work surface 112 when it is closed.

Each of the support panels 114, 115 is mounted and cycled between the open and closed positions in the manner described above with respect to FIGS. 1-5 (i.e. utilizing the combination of two lever assemblies 20 and a hydraulic damper 170). Flat panel displays 60 are fixedly mounted to the underside of support panels 114, 115 and a sliding keyboard and mouse platform 30 is mounted on telescoping roller brackets 26 underneath the edge of the work surface 112 directly in front of each support panel 114, 115 and flat panel display 60.

As a preferred option, the sliding keyboard and mouse platforms 30 in the embodiments described above with respect to FIGS. 1-6, may be equipped with a locking device, such as a simple keylock, which prevents unauthorized access to the keyboard and the flat panel display 60 when protection of the hardware is desired.

Figure 7:
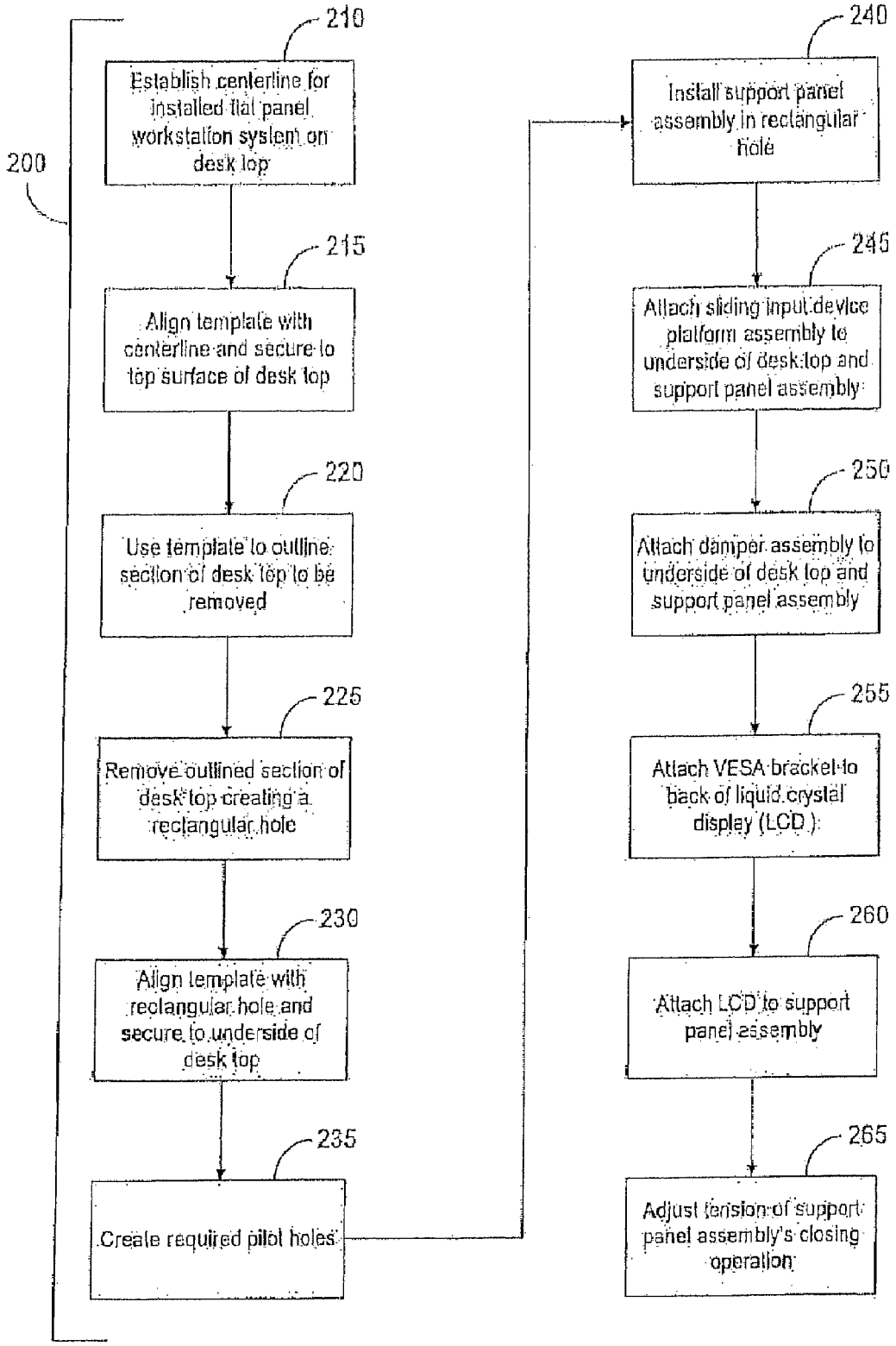
FIG. 7 is a flowchart of the method 200 for retrofitting the flat panel workstation system 10 of the present invention to a desk top 12.

FIG. 7 is a flowchart of the method 200 for retrofitting the flat panel workstation system 10 of the present invention to a desk top 12. In the discussion of the method 200 of the present invention below; (1) the "support panel assembly" includes the collar 14, the support panel 14, two lever arms 22 and bases 44, and two pivot shafts 46; (2) the "sliding keyboard and mouse platform assembly" includes the sliding keyboard and mouse platform 30, two roller brackets 26, two links 24, and two shoulder bolts 50; and (3) the "damper assembly" includes the damper 170 with its shaft 172, the ball/socket assembly 174, the L-shaped bracket 176, and the slotted bracket 180.

Figure 8:
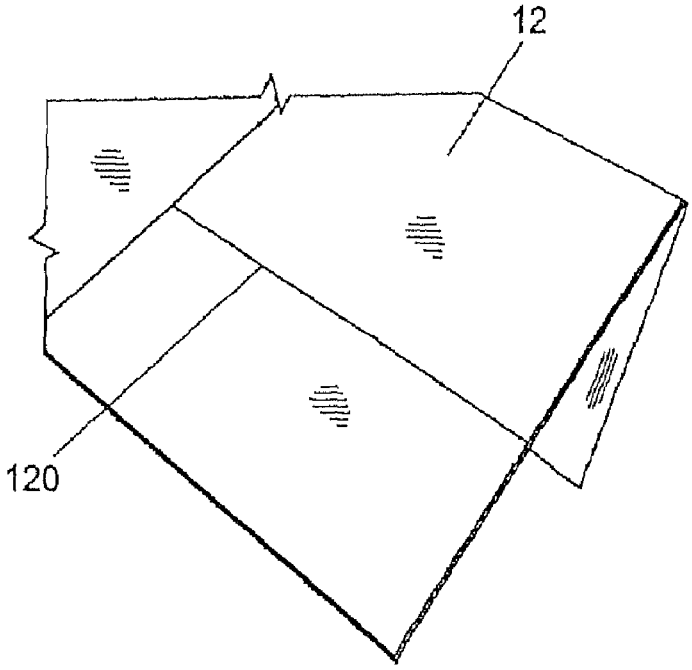
FIG. 8 is a top perspective view of the desk top 12 showing a centerline 120 about which the flat panel workstation system will be installed.

At Step 210, as shown in FIG. 8, a centerline 120 about which the flat panel workstation system 10 will be installed is established on the desk top 12. The desk top 12 should have a clearance area of approximately 23"×29" (14.5" on either side of the centerline 120) to accommodate the installation as shown.

Figure 9:
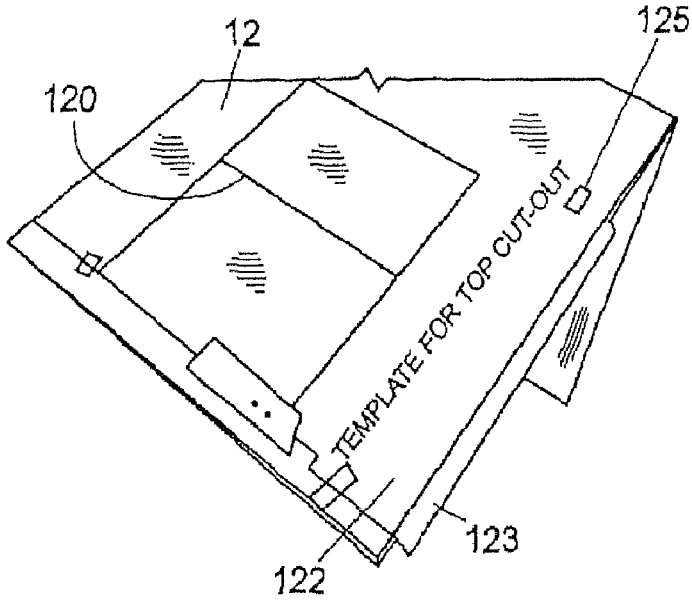
FIG. 9 is a top perspective view of the desk top 12 showing an attached system installation template 122.

At Step 215, a template 122, that is supplied as a component of the flat panel workstation system 10 retrofit kit, is aligned as shown in FIG. 9 with the centerline 120 established at Step 210. A tab 123 of the template 122 is folded and positioned against the front edge of the desk top 12 before the template 122 is secured to the top surface of the desk top 12 by, for example, multiple pieces of adhesive tape 125.

Figure 10:
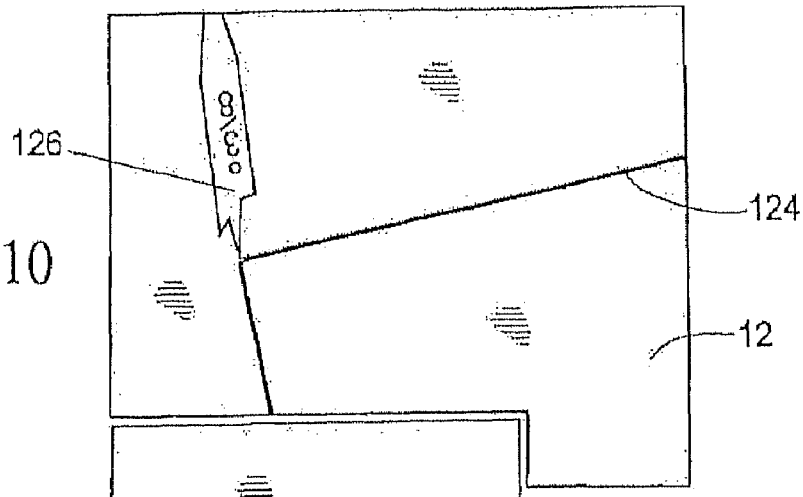
FIG. 10 is a close-up view of an installation outline 124 drawn on the desk top 12 and a drill bit 126.
Figure 11:
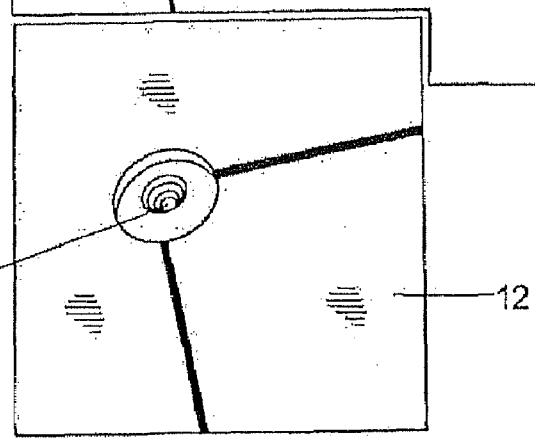
FIG. 11 is a close-up view of a partially completed hole 128 formed in the desk top 12 using the drill bit 126 of FIG. 10.
Figure 12:
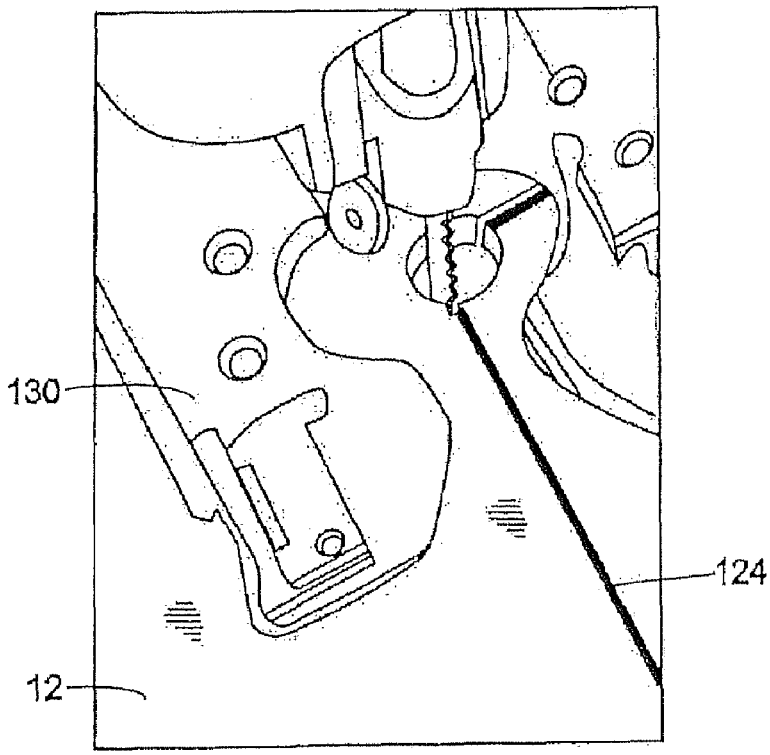
FIG. 12 is a close-up view of a jig saw 130 being used to cut along the installation outline 124 drawn on the desk top 12.

At Step 220, a permanent marker is used to trace the perimeter of the cut-out area of the template 122 to outline the section of the desk top 12 that is to be removed to make room for the flat panel workstation system 10 (see the installation outline shown in FIGS. 10-12). At Step 225, the outlined section of the desk top 12 is removed leaving a substantially rectangular hole. This is accomplished as shown in FIGS. 10-12. First, four comer starting holes 128, such as the partially completed one shown in FIG. 11, are drilled completely through the desk top 12 after placing the tip of the drill bit 126, in turn, at the comer marks (see FIG. 12) of the installation outline 124. Then, using a jigsaw 130, cut along the outside edge of the outline 124 such that the entire marker line is on the section of the desk top 12 that is cut out.

Figure 13:
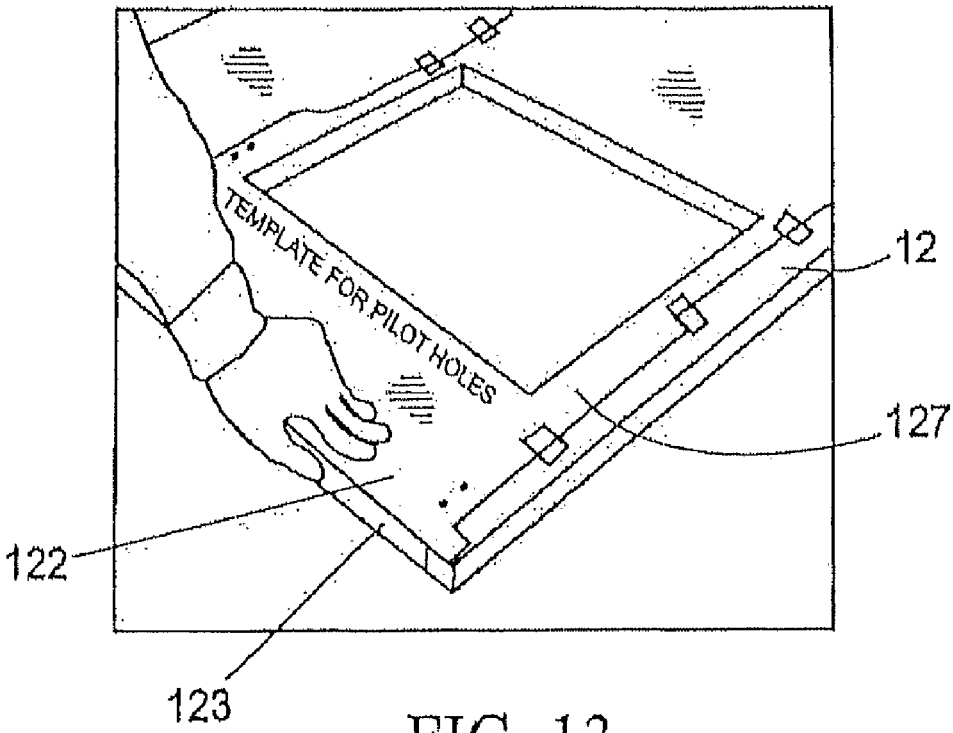
FIG. 13 is a perspective view of the underside of the desk top 12 showing the attached system installation template 122.

At Step 230, as shown in FIG. 13, the template 122 is aligned, along the underside of the desk top 12, with the rectangular hole created at Step 225. A tab 123 of the template 122 is folded and positioned against the front edge of the desk top 12 before the template 122 is secured to the underside of the desk top 12 by, for example, multiple pieces of adhesive tape 125. The locations, as indicated by the template 122, of multiple pilot holes 127 are then marked. At Step 235, the plurality of pilot holes, marked at Step 230, are drilled into the underside of the desk top 12. Each pilot hole is preferably ⅛" diameter×⅜" deep.

Figure 14:
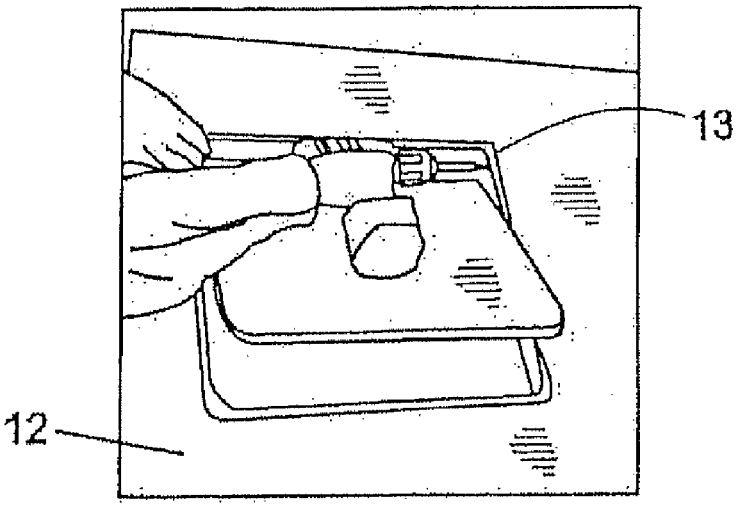
FIG. 14 is a top perspective view of the desk top 12 showing the manner in which the collar 13 is attached.

At Step 240, as shown in FIG. 14, the support panel assembly is installed in the rectangular hole created at Step 225. This is accomplished by placing the support panel assembly in the rectangular hole such that the lever arms 22 (that will eventually be connected to the sliding keyboard and mouse platform assembly) are angled toward the back edge of the desk top 12. Then, after creating four pilot holes dimensioned identically to those created at Step 235, attach the collar 13 within the rectangular hole using four wood screws.

Figure 15:
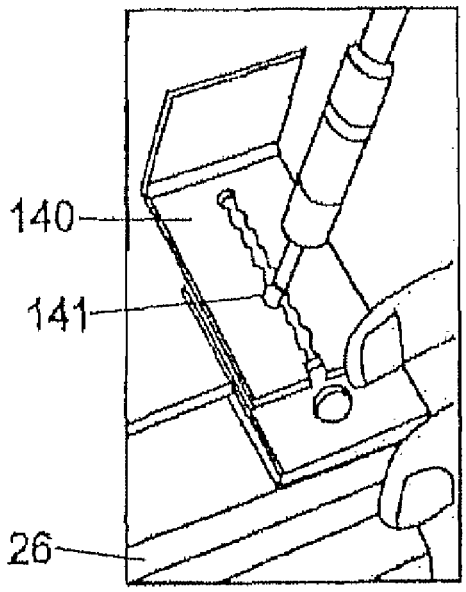
FIG. 15 is a perspective view showing the manner in which a mounting bracket 140 is attached to a roller bracket 26.
Figure 16:
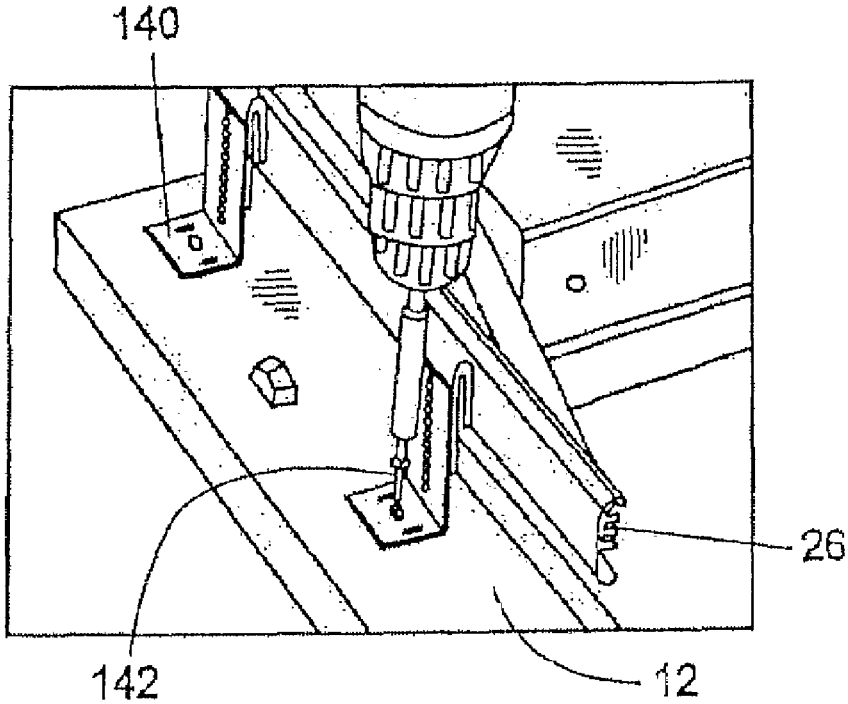
FIG. 16 is a perspective view showing the manner in which a mounting bracket 140 is attached to the underside of the desk top 12.

At Step 245, the sliding keyboard and mouse platform assembly is attached to the underside of the desk top 12 and the support panel assembly. First, as shown in FIG. 15, two mounting brackets 140 are attached to each roller bracket 26 using a screw 141. Then, as shown in FIG. 16, each of the brackets 140 is attached to the underside of the desk top 12 by installing two screws 142 in the corresponding pilot holes created at Step 235. Finally, the sliding keyboard and mouse platform assembly is pivotally attached to the support panel assembly by connecting an end of each link 24 to the free end of each lever arm 22 (see FIG. 5).

Figure 17:
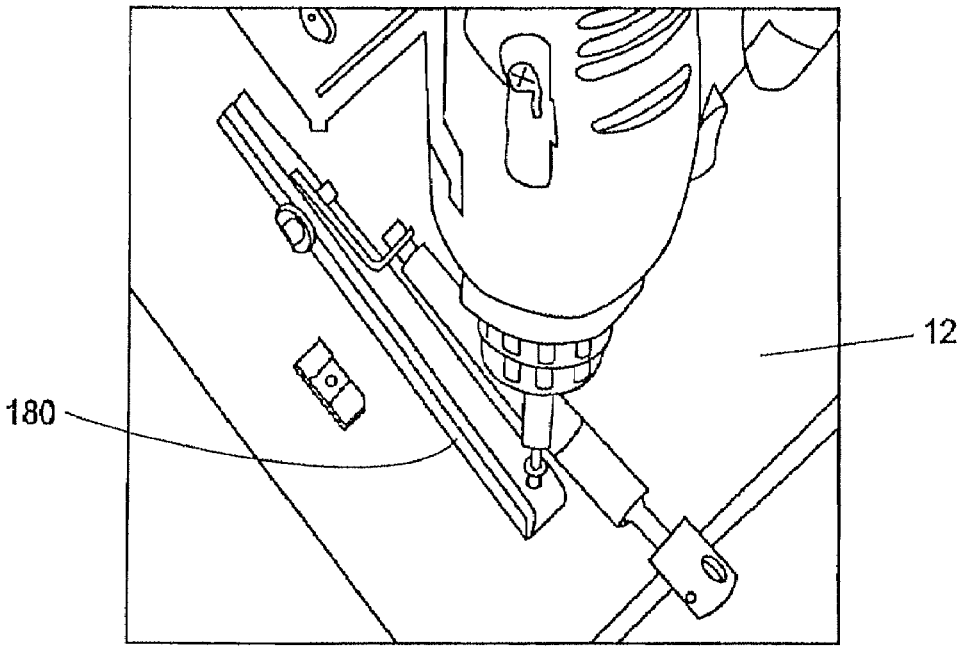
FIG. 17 is a perspective view showing the manner in which a slotted bracket 180 is attached to the underside of the desk top 12.
Figure 18:
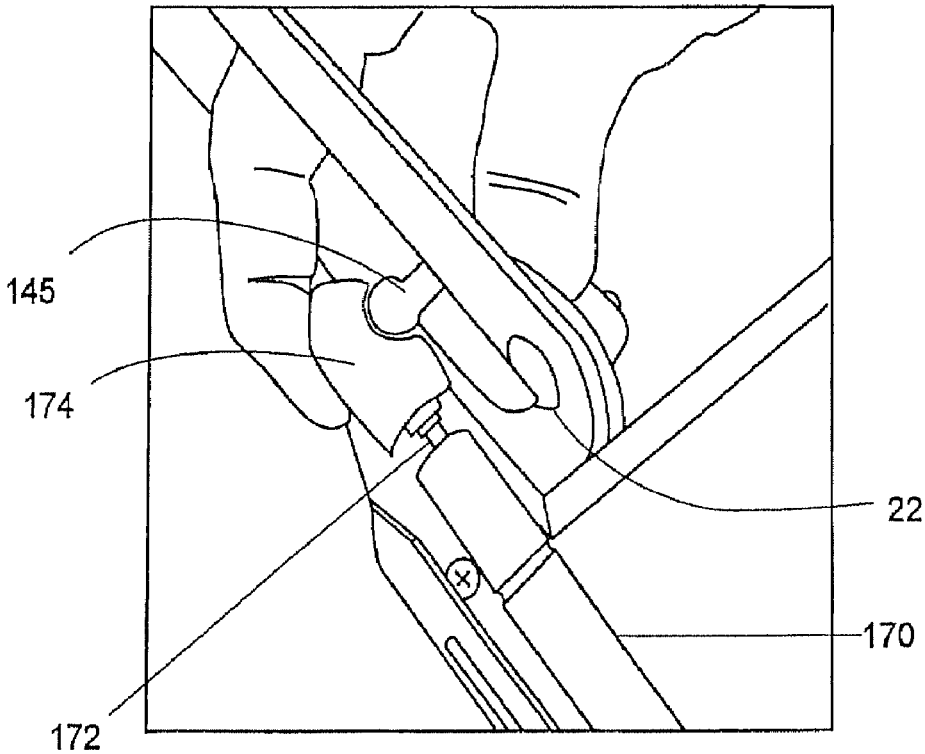
FIG. 18 is a perspective view showing the manner in which a ball/socket assembly 174 is connected to a lever arm 22.

At Step 250, as shown in FIG. 17, the damper assembly is attached to the underside of the desk top 12 by installing two screws 143 through the slotted bracket 180 and into the two corresponding pilot holes created at Step 235. The damper assembly is then, as shown in FIG. 18, connected to one of the support panel assembly's lever arms 22 by inserting a ball 145 affixed to that arm 22 into the ball/socket assembly 174 attached to the shaft 172 of the damper 170.

Figure 19:
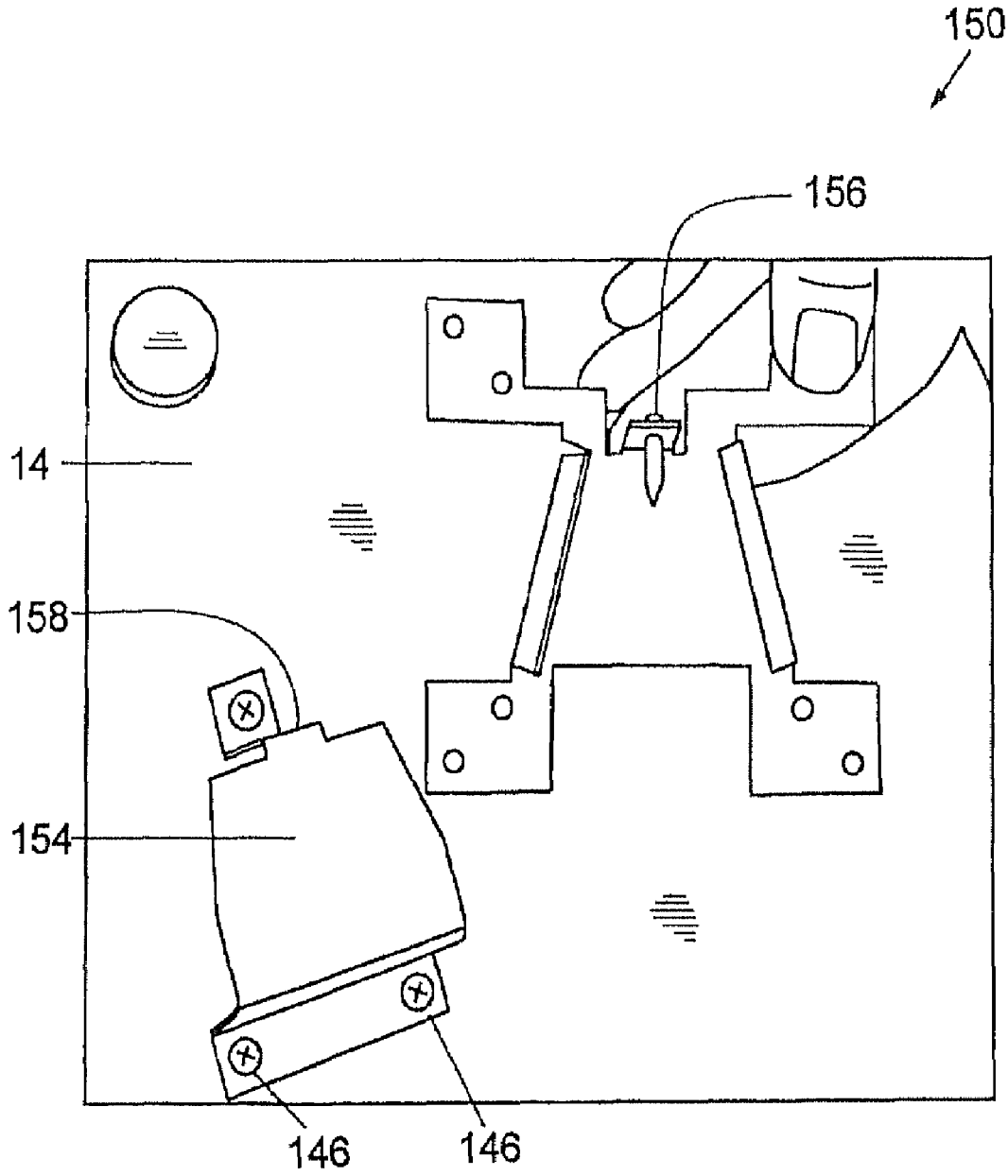
FIG. 19 is an exploded view of a VESA bracket assembly 150.

At Step 255, as shown in FIG. 19, a VESA mounting bracket 152 is attached to the back of the Flat panel display 60. The VESA mounting bracket 152 is one of the two primary components found in the VESA bracket assembly 150 which is present, but not visible between the support panels 14 and LCDs 60 of FIGS. 3-5). The other component of the assembly 150 is a VESA mounting plate 154. The VESA mounting plate 154 is formed with a retaining pin hole 158 and is attached to the support panel 14 by four screws 146. The VESA mounting bracket 152 includes a spring-loaded retaining pin 156 for catching the VESA mounting plate 154, and may be attached to the rear surface of the flat panel display 60 by four screws.

Figure 20:
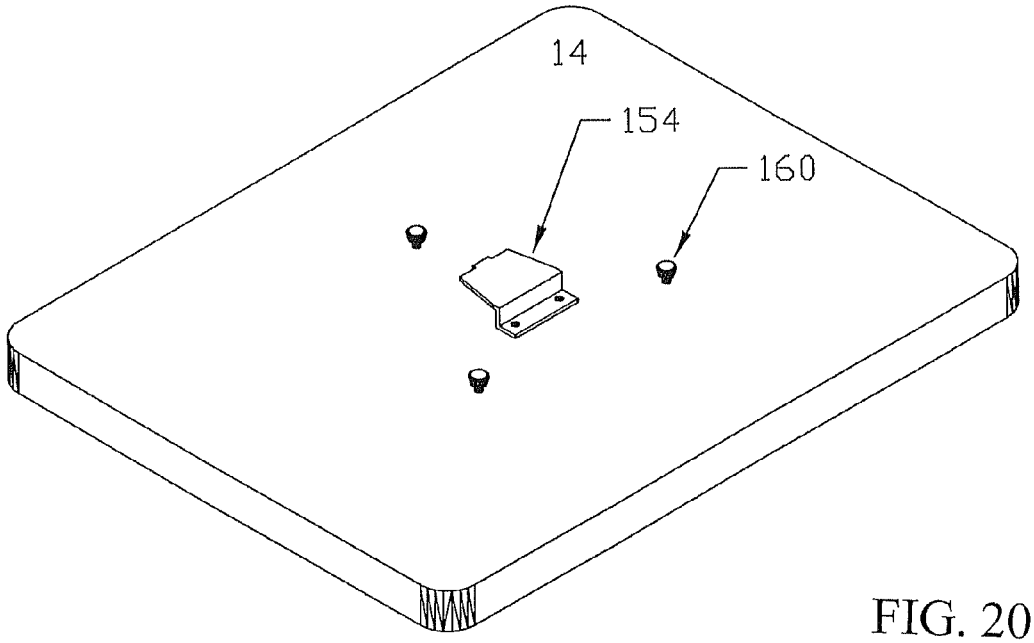
FIG. 20 is a perspective view of the support panel 14 showing an attached VESA mounting plate 154 and three LCD supports 160.

At Step 260, the flat panel display 60 is attached to the support panel assembly by sliding the VESA mounting bracket 152 of FIG. 19 onto the VESA mounting plate 154, shown in FIG. 20, such that the back of the Flat panel display 60 rests against the three LCD supports 160. The supports 160 are threaded into the support panel 14 and, therefore, the extent to which they extend out of the panel 14 may be adjusted such that they contact and support the back of the Flat panel display 60. The tapered configuration of the interfacing surfaces of the bracket 154 and plate 152 combined with the interaction of the spring-loaded retaining pin 156 and the retaining pin hole (see FIG. 19) serve to snugly hold the Flat panel display 60 in place during any rotation of the support panel assembly.

Figure 21:
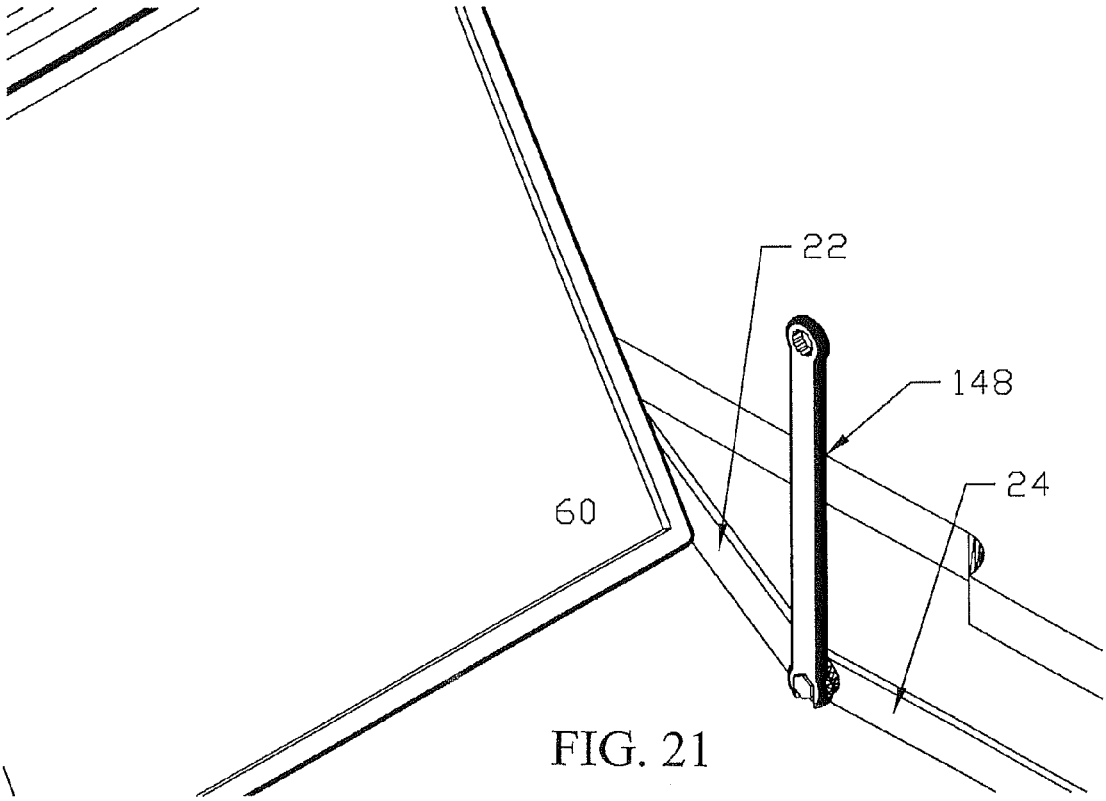
FIG. 21 is a perspective view showing the manner in which the tension of the closing operation of the flat panel workstation system 10 is adjusted.

Finally, at Step 265, the tension of the closing operation of the flat panel workstation system 10 is adjusted. As seen in FIG. 21, a wrench 148 may be used to adjust the connection between the lever arms 22 and the links 24 to control the force exerted by the combined weight of the support panel (not shown in FIG. 21) and the flat panel display 60 on the damper assembly as the support panel assembly approaches its fully closed position.

The system 10 and method 200 of the present invention make it possible to retrofit any desk top/work surface 12, or like structure, with a flat panel display 60 that is ergonomically positioned to maximize its "viewability". The pivoting of the flat panel display 60 from a stored to a viewable position is triggered automatically by the user extending a sliding (i.e. pullout) keyboard and mouse platform. Furthermore, the closing action of the system is controlled so as to protect the delicate circuitry of the unit and to prevent personal injury and/or damage to any associated structure.

Having now fully set forth the preferred embodiments and certain modifications of the system and method concepts underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

We claim:

1. A system for holding and displaying an electronic flat panel display comprising:

a. a collar for fixedly mounting said system in an aperture in an existing work surface;

b. an electronic flat panel display support panel for pivotally mounting within said collar;

c. a keyboard platform movably attached below the underside of said work surface; and d. a lever mechanism positioned on either side of said keyboard platform and each coupled between said keyboard platform and said support panel, said lever mechanism connected so that said electronic flat panel display support panel is pivoted on collinear pivots, which are attached to said collar, wherein said flat panel display support panel pivots, to an ergonomically correct, open and upright position upon extension of said keyboard platform, and said electronic flat panel display support panel is pivoted to a closed position upon retraction of said keyboard platform.

2. The system according to claim 1, further comprising a motion damping mechanism attached between said lever mechanism and said underside of said work surface for bringing said display support panel to a gentle stop at said closed position.

3. The system according to claim 2 wherein said system further comprises a switch for automatically applying power to said electronic flat panel display upon said electronic flat panel display support panel attaining said open, upright position, said switch activated such that when the electronic flat panel display travels to a viewable orientation, the switch is turned on.

4. The system according to claim 1, wherein said electronic flat panel display support panel is mounted within said collar on collinear pivot shafts.

5. The system according to claim 1, wherein said keyboard platform is slidably mounted to an underside of said work surface by roller brackets.

6. The system according to claim 5, wherein said roller brackets further comprise two telescoping roller brackets.

7. The system according to claim 6 comprising a lever mechanism on either side of said electronic flat panel display panel, wherein said lever mechanism comprises two lever assemblies each connected between one of said roller brackets and a side of said electronic flat panel display support panel.

8. The system according to claim 1, further comprising a lock for locking said keyboard platform in a closed position.

9. The system of claim 1, wherein multiple units of said systems are installed into a single multiple user work surface.

10. The system according to claim 1 wherein said electronic flat panel display panel is raised to a position which is easily viewable to a seated user but still allow the user to clearly see a speaker, or instruction display over the electronic flat panel display panel.

11. The system of claim 1, wherein said electronic flat panel display panel is raised to a position which allows an ergonomically correct, ideal, viewable angle when open.

12. A method for retrofitting a system for holding and displaying an electronic flat panel display into a new existing work surface comprising mounting said display into a collar for mounting said system in an aperture into said existing work surface, said method comprising:

a. said electronic flat panel display support panel being pivotally mounted within said collar and positioning the collar into an aperture of a generally flat work surface, cut to the general size of the collar;

b. installing a movable keyboard platform underneath said work surface;

c. attaching a damper assembly to the underside of the work surface and the flat panel display support panel;

d. attaching a mounting bracket to the back of the flat panel display screen panel;

e. attaching the flat panel display screen to the flat panel display support panel; and f. positioning a connector mechanism on either side of said keyboard platform and each coupled between said keyboard platform and said support panel, said connector mechanism connected so that said electronic flat panel display support panel is pivoted to an open and upright position upon extension of said keyboard platform, and said electronic flat panel display support panel is pivoted to a closed position upon retraction of said keyboard platform.

13. A method of moving an electronic flat panel display secured to a new or existing work surface from a closed, secured position to an open position in front of a user, said method comprising installing a connection mechanism which automatically triggers the movement of the electronic flat panel display panel from a stored position to a viewable position by the user extending a keyboard platform, said system comprising:

a. a collar for fixedly mounting said system in an aperture in the existing work surface;

b. an electronic flat panel display support panel for pivotally mounted within said collar;

c. a keyboard platform movably attached underneath said work surface;

d. a mechanism for connecting said flat panel display support to said keyboard platform such that movement of said keyboard platform automatically moves said flat panel display from a closed position to an open position, and wherein said electronic flat panel display support panel is pivotally mounted within said collar and e. the user moving said keyboard platform to a position under said work surface which automatically moves said electronic flat panel display to a closed position.

14. The system of claim 1, wherein a mounting bracket is attached to the back of the flat panel display screen panel.

15. The system of claim 14, wherein said mounting bracket is a VESA bracket.

* * * * *